US010953446B2

(12) United States Patent
Rossi

(10) Patent No.: US 10,953,446 B2
(45) Date of Patent: Mar. 23, 2021

(54) APPARATUS FOR FORMING ROUND AND FLAT-OVAL SHAPED HVAC DUCTS

(71) Applicant: Jose Rossi, Guaynabo, PR (US)

(72) Inventor: Jose Rossi, Guaynabo, PR (US)

( * ) Notice: Subject to any disclaimer, the term of this patent is extended or adjusted under 35 U.S.C. 154(b) by 0 days.

(21) Appl. No.: 16/688,505

(22) Filed: Nov. 19, 2019

(65) Prior Publication Data

US 2020/0086369 A1 Mar. 19, 2020

Related U.S. Application Data

(63) Continuation-in-part of application No. 15/843,856, filed on Dec. 15, 2017, now Pat. No. 10,480,814.

(60) Provisional application No. 62/472,236, filed on Mar. 16, 2017, provisional application No. 62/487,241, filed on Apr. 19, 2017.

(51) Int. Cl.

| | |
|---|---|
| ***B21B 17/14*** | (2006.01) |
| ***F24F 13/02*** | (2006.01) |
| ***B21D 5/14*** | (2006.01) |
| ***B21B 37/78*** | (2006.01) |

(52) U.S. Cl.

CPC ..... *B21B 17/14* (2013.01); *B21B 37/78* (2013.01); *B21D 5/14* (2013.01); *F24F 13/0245* (2013.01)

(58) Field of Classification Search

CPC ..... B21B 17/00; B21B 17/10; B21B 17/14; B21B 19/00; B21B 19/12; B21B 19/16; B21B 29/00; B21B 37/38; B21B 37/42; B21B 5/00; B21D 7/02; B21D 7/022; B21D 7/024; B21D 7/08; B21D 17/04; B21D 5/14; B21D 5/004; F24F 13/0245

See application file for complete search history.

(56) References Cited

U.S. PATENT DOCUMENTS

| | | | | |
|---|---|---|---|---|
| 4,057,990 A * | 11/1977 | Kelsey | B21D 5/14 | 72/166 |
| 5,187,959 A * | 2/1993 | Davi | B21D 5/14 | 72/10.6 |
| 8,959,976 B2 * | 2/2015 | Cha | B21D 17/04 | 72/379.6 |
| 10,046,378 B2 * | 8/2018 | Kato | B21D 5/02 | |

* cited by examiner

*Primary Examiner* — Pradeep C Battula
(74) *Attorney, Agent, or Firm* — Eugenio J. Torres-Oyola; Victor M. Rodriguez-Reyes; Ferraiuoli LLC

(57) ABSTRACT

An apparatus for forming a round or oval shaped duct for all AC systems in one continuous operation where two driving rolls advance a flat metal sheet to at least one multi-positioning bending roll, where the at least one bending roll is moveable to a bending position for different curvatures and a non-bending position. The driving rolls advance the sheet through while the bending roll bends the sheet to form the curved sides, and the bending roll in the non-bending position form the flat sides of the oval shaped duct. A position sensor detects the position of the flat metal sheet in the rolls to control the location along the sheet where the bending roll is moved to either of the bending or non-bending positions while the driving rolls are stopped. An adhesive dispenser joins both ends of the sheet, resulting in a complete duct.

6 Claims, 8 Drawing Sheets

APPARATUS FOR FORMING ROUND AND FLAT-OVAL SHAPED HVAC DUCTS

CROSS-REFERENCE TO RELATED APPLICATIONS

This application claims the benefit to U.S. patent application Ser. No. 15/843,856 filed Dec. 15, 2017 and entitled APPARATUS AND PROCESS FOR FORMING AN OVAL SHAPED HVAC DUCT, U.S. Provisional Applications 62/472,236 filed Mar. 16, 2017 and entitled APPARATUS AND PROCESS FOR FORMING AN OVAL SHAPED AND A ROUND HVAC DUCT, and 62/487,241 filed Apr. 19, 2017 and entitled APPARATUS AND PROCESS FOR FORMING AN OVAL SHAPED HVAC DUCT AND A ROUND DUCT.

GOVERNMENT LICENSE RIGHTS

None

BACKGROUND OF THE INVENTION

Field of the Invention

The present invention relates generally to a Heating, Ventilation, and Air Conditioning (HVAC) duct, and more specifically to an apparatus for forming both round and oval HVAC ducts automatically in one continuous cycle, that can replace rectangular ducts that are still predominant in the fabrication of ducts for the air distribution systems in the HVAC industry throughout the world as well as the less predominant balance of ducts still fabricated by the existing round and oval-shaped ducts used throughout the world.

For many years, most probably exceeding one hundred years, the distribution of Heating and Ventilation air was done through rectangular ducts or conduits. More recently, approximately 40 to 50 years ago, with the advancement in the air conditioning industry then and now designed for the comfort of occupants inside buildings, a well-regulated system for the Air Distribution Systems (ADS) in the Heating, Ventilation and Air Conditioning (HVAC) industry was developed with round and oval-shaped ducts intended to replace the rectangular ducts. But although the rectangular duct configuration is very inefficient for air movement anywhere, it is superior to round ducts in its flexibility to assume larger widths while decreasing its height and keeping the overall vertical space for the central air conditioning systems at a reasonable level. Yet, in spite of its many drawbacks and inefficiencies, rectangular ducts remain to this date the dominant figure for ducts designed, fabricated and installed in central heating, ventilation and air conditioning systems throughout the world. The reason for the dominant position of the rectangular ducts lies in the fact that the width of rectangular ducts can be increased while its height is decreased to fit into the vertical space made available by the Architect. The round duct cannot do that since it has a constant diameter with an equal size in all directions including its vertical and its horizontal dimensions. The market for ducts has therefore ended by being divided between the really large jobs, which the small and medium sized shops do not have the financial capacity to handle, and the small to medium size jobs in which the large national shops are not able to compete due to the logistics involved in handling a large number of small and medium sized projects for different customers at the same time. This holds true for the old existing technology for fabrication of round and oval-shaped ducts that has been available in the open market for some 40 to 50 years, without any major improvements, but not so for the new technology that is object of the present invention, as we shall see herein.

Contrary to rectangular ducts, round ducts have the most efficient configuration of all forms used for the transportation and distribution of air in the HVAC industry and carries the lowest cost for the air distribution systems in this industry. Its only disadvantage, as stated above, rests on its inflexible relationship between its height and its width resulting from a diameter that is equal in all directions. This is detrimental for the overall height of a building that has to provide the vertical space to install the air distribution ductwork in all floors of the building. The old but still existing technology takes care of the above situation with the round ducts by a very simple expedient. It first makes a round duct of a proper size, and then "ovalizes" it in a second separate process. This two-step process requires the equipment to first make round spiral ducts with a different die for each size of the round ducts. The second step requires another set of equipment consisting in a hydraulic machine that has two structural steel beams that are inserted inside the round spiral ducts with rounded-out dies and rectangular or square separators attached to them that will pull out and stretch the round duct outwards forming an oval-shaped duct through the deformation of the round duct. This goes on slowly until the steel material of the round duct reaches its yield strength and the now oval shaped duct attains its permanent deformation into a flat oval-shaped duct replacing the round spiral duct. This was an ingenuous solution to replace the inefficient rectangular duct system. However, it carries the stigma of requiring a very high capital investment for both sets of equipment, requiring a large floor space for the two-step process, requiring the storage, moving and installation of dies for the first step and dies and separators for the second step, requiring a large amount of time for the fabrication of each piece, and having a high initial cost not only in the required capital investment but throughout the entire process, including the design phase. Add to this the additional operating cost for die changing in step No. 1 and for die and separator changes in step No. 2, together with several other very important disadvantages that the new technology now cures for the design, fabrication, installation, maintenance and operation costs for both round and oval ducts, and the longevity that this new process and technology has over both the old, existing technology for the fabrication of round and oval ducts as well that for the fabrication of rectangular ducts and you will have a clear picture for the advantage of the New Process and New apparatus over the old exiting process and apparatus for the fabrication of either a round or an oval-shaped duct in one single continuous cycle. The new technology, with its modern computer numerical controls (CNC), allows for the fabrication of both round ducts and oval-shaped ducts in whatever sizes these are required. It does so in one continuous single pass for the intermittent fabrication of both round and oval-shaped ducts. This capability, together with the one to fabricate reinforced light-weight sheet-metal raw material as part of the fabrication process, brings the cost to fabricate oval-shaped ducts very close to the fabrication of round ducts, and a much lower cost than that for the fabrication of rectangular ducts.

The overall height of the building can now be kept to that which is desired by the architect as much with round and oval-shaped ducts as with rectangular ducts, with the cost advantage now on the side of the oval ducts and the simple expedient of fabricating the height and the width of the oval ducts so as to fit in the space made available by the architect. The existing technology has a much higher cost for fabrication of oval-shaped ducts through the "ovalization" of a previously fabricated round duct in the appropriate and precise size needed for its final oval configuration, and eliminates in a definite manner the alternative of having a taller building that would require heavier foundations due to the additional weight of the building, and the additional cost of the structural work and the finishing work of the building due to the areas requiring additional structural and finishing work, both in the interior and in the exterior areas, with the result of a much more expensive building. This is undoubtedly not acceptable to the architect and to the owner of the building who have established a final budget for the overall cost of the building.

Thus in the overall picture, the inefficiencies inherent in rectangular ducts are presently offset in part by their ability to exchange width for height for a lower overall building cost; but this advantage for rectangular ducts is no longer valid against the new oval duct herein proposed.

The fan motor also represents another advantage of the present invention since it can be smaller and will draw a lower amperage with a resulting lower energy cost. The noise level due to the air movement inside rectangular ducts will also be decreased significantly with round and oval-shaped ducts over that for rectangular ducts, regardless of the technology used to fabricate oval ducts. This represents a significant improvement for the use of round and oval-shaped ducts over that for rectangular ducts.

The noise level emanating from air ducts is limited by the regulatory authorities and will require larger sizes in the ductwork for its noise control, and thus higher material, labor and other costs for its installation, maintenance and replacement.

In summary, in spite of the advantages that the existing round and oval-shaped duct technology has in comparison with the rectangular duct systems, the rectangular duct systems remain to this day the dominant method for the air distribution systems for the HVAC industry. Therefore, a more economically viable system for creating round and oval-shaped HVAC ducts is necessary.

Description of the Related Art

All references, including any patents or patent applications cited in this specification are hereby incorporated by reference. No admission is made that any reference constitutes prior art. The discussion of the references states what their authors assert, and the applicants reserve the right to challenge the accuracy and pertinence of the cited documents. It will be clearly understood that, although a number of prior art publications are referred to herein, this reference does not constitute an admission that any of these documents form part of the common general knowledge in the art.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning—i.e. that it will be taken to mean an inclusion of not only the listed components it directly references, but also other non-specified components or elements. This rationale will also be used when the term 'comprised' or 'comprising' is used in relation to one or more steps in a method or process.

When the word "invention" is used in this specification, the word "invention" includes "inventions", that is, the plural of "invention". By stating "invention", the Applicant does not in any way admit that the present application does not include more than one patentable and non-obviously distinct invention and Applicant maintains that the present application may include more than one patentably and non-obviously distinct invention. The Applicant hereby asserts, that the disclosure of the present application may include more than one invention, and, in the event that there is more than one invention, that these inventions may be patentable and non-obvious one with respect to the other.

Further, the purpose of the accompanying abstract is to enable the U.S. Patent and Trademark Office and the public generally, and especially the scientists, engineers, and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

In the HVAC industry, air is moved through a building using ducts. Typically, these ducts are formed as rectangular cross-sectional shaped ducts since rectangular ducts can be made in the width and height best suited to the space made available by the design architect and engineer, and be easily fabricated in small shops with a minimum investment in machinery and equipment. Ducts are positioned between a ceiling and the floor above which is referred to as the duct work space. The duct work space must be tall enough to fit the required duct size so that adequate air flow can be delivered to the various rooms in the building.

Rectangular ducts can be made with the width greater than the height so that increasing the width allows a shorter vertical dimension for the duct and a smaller vertical work space is required for the duct works. However, a rectangular duct is relatively inefficient at moving air as compared with a round duct. A round shaped duct is more efficient and less costly to fabricate and to install than a rectangular shaped duct, and also much less prone to develop air leaks than a rectangular duct, and so are the oval ducts that will be fabricated in the proposed new machine or apparatus. A round duct requires the largest height of the duct works space since its diameter has the same dimension in both the vertical and the horizontal direction. For a building with many floors, the round duct work would require a lot of additional height for the overall building height. Even for a one story building the Architect may consider the additional height required for a round duct to be unacceptable since other solutions are available, namely the rectangular ducts, as well as the equivalent oval ducts for the building.

All ducts and other components of an air distribution system for HVAC must be designed, fabricated and installed within the space made available by the architects and engineers engaged in the design of the building for each individual project. This space is normally limited so as not to increase the height of the building more than good design parameters established in the architectural profession.

All utilities installed within buildings, with the sole exception of air distribution duct systems, use round pipes for such distribution. Square or rectangular configurations of water distribution systems in cities disappeared shortly after the fall of the Roman Empire. Rectangular configuration in conveying systems for any fluid have remained a standard only in the HVAC industry.

Round duct fabrication and installation is by far the most economical configuration available in the HVAC industry. It is also considerably more leak-proof than rectangular ducts. Oval duct fabrication is now specified by design engineers and architects as a substitute for round ducts that cannot fit in the spaces allocated for duct work. Presently, the existing oval ducts are made by first producing a round duct on a first machine, and then using a second machine in which the round duct is stretched outwards to form an oval shaped duct. The second machine to form the oval shaped duct uses dies with the desired curvature for the oval shaped duct so that a good number of these dies are needed for the different size of oval shaped ducts to be fabricated. However oval duct fabrication costs now soar above those for rectangular ducts except when done in very large quantities for each size. Also, the cost of the equipment now required to fabricate first a round duct and then transform the round duct into an oval duct that will fit within the available space provided by the design architects and engineers is extremely high, especially when only one, or a small number of the same size duct is to be fabricated at any given time.

One of the most important, if not the most important, reasons for the apparent anomaly in the preference for rectangular ducts is the need to distribute conditioned air throughout a building at very low pressures and discharge it into the conditioned spaces at low velocities and in a noiseless fashion. The design pressures for air distribution purposes in the HVAC industry ranges from ½ inch to 10 inch water gage. Water and all other fluids moved within a building are commonly moved at 60 to 150 psi in round pipes. This is equivalent to 166 times the 60 psi figure, and 415 times the 165 psi pressure compared with 10 inches water gage. The conversion from psi (pounds per square inch) to inches water gage ("water gage") is 1 psi=27.68" water gage. Therefore, conveyance of air inside buildings at high pressures in small sized piping is not acceptable due to both noise considerations as well as to comfort considerations for personnel occupying the air conditioned areas. Small round ducts designed to carry air at high speed and high pressure would create an unacceptably high noise level and an equally unacceptable high velocity discharge of air from the supply air outlets into the room with an unacceptable amount of discomfort for the people occupying the room. Thus any improvement contemplated for this industry in its air distribution systems must take into consideration the need for low velocity and noiseless discharge of conditioned air into occupied spaces.

Replacing a rectangular shaped duct with a round duct is not feasible in many cases, particularly for large amounts of air because of the limited space allowed by Architects and design engineers for ductwork inside buildings. For the round shaped duct to replace the normal rectangular shaped ducts with good design criteria would require the round duct to have a diameter much greater than the height of the rectangular shaped duct to move the same amount of air in a noiseless fashion. An oval shaped duct would be required to replace a rectangular shaped duct in the same space for the same air flow.

An oval shaped duct with a width greater than the height has been proposed which is more efficient at moving air than a rectangular duct but takes up the same amount of space than the rectangular duct. However, the current process of forming the existing oval ducts is very costly at present, so much so that the less efficient rectangular ducts are still being used predominantly in the great majority of cases as compared to the combination of round and oval ducts. Presently to form an oval duct, a round duct is first formed. Then, the rounded duct is placed on a second machine, outside two beams which are pushed apart by hydraulic force stretching the duct to form the oval shape. Thus, the cost of producing oval shaped duct is not cost-effective for most of the HVAC projects. Also the probability for air leaks is increased due to the stretching force of the two beams within the spiral joint round duct, to reach stretching the round form outwards until the yield strength of the steel is reached. This action may be a factor that contributes significantly to air leakage in such ducts.

Flat oval-shaped ducts as well as round ducts do the best job in avoiding Eddy currents and the amount of drag caused by them. The smooth movement of air in the curved surfaces of round and oval shaped ducts practically eliminates Eddy currents. This in turn decreases the pressure drop in the ducts as well as the objectionable noise created by its turbulent movement in rectangular ducts.

The factor for the air leakages permitted in a rectangular duct by the Regulatory Authorities is exactly twice the amount of that allowed by them for round and oval-shaped ducts. This is due to the extremely high difficulty in sealing rectangular ducts permanently both at the Shop and in the Field. But round and oval-shaped ducts also have a very significant permissible air-leakage factor for all installations in the air distribution systems in the HVAC Industry. These must be avoided and corrected in order to eliminate the high energy loss accruing from these air leakages.

Energy savings and green buildings are part of our everyday advancement in modern construction methods. More rigid specifications for practically all new building construction is something that must be addressed and put in practice continuously in order to keep this industry improvements on a par basis with most other modern industries now days. The HVAC industry is an important part of the construction industry and must follow its trends to keep up with it. But it has fallen behind in this trend for many years, due in part to the technology used during the past forty to fifty years or more that still make the inherently inefficient rectangular construction of ducts for the air distribution systems in HVAC industry totally prevalent over the more efficient round and oval shaped configuration of ducts. But, even the round and oval shaped ducts manufactured up to this day suffer from a technology that has not changed or been improved for several decades with respect to air leakages from ducts with the resulting energy loss caused by such leakages. The modern joint treatment for long term cementing of all longitudinal and transverse duct joints and sealing them with the guaranteed procedure described below and the Trade-Name "Cold Weld" and "Perma-Seal" will provide the means for the elimination of such Energy Waste in the ADS Section of the of the HVAC industry. It follows that where a Joint is so well cemented that it suffers no displacement a good elastic sealant will not crack and permit any fluid leakages through such cracks, and will thus last for a very long period of time without such leakages.

BRIEF SUMMARY OF THE INVENTION

An apparatus and a process of forming round and oval shaped HVAC ducts using a single piece machine in which a flat sheet of metal is rolled with several rollers. These can be variably positioned during the rolling process to form the different curvatures in order to form either an oval shaped duct or a round duct. The present invention is designed for manufacturing an enclosed and continuous duct 3 to 5 feet in length for the air distribution system. This length is based on the availability of the raw material in sheets or coils in these lengths and for sheet-metal thicknesses between Gauge 26 and Gauge 16. Lengths shorter than 3 feet or larger than 6 feet may be used in an apparatus designed for such lengths within the scope of the present application as these sizes become available from sheet and coil manufacturers and steel centers. The machines in this application can form either oval ducts or round ducts from flat or bead reinforced sheets of galvanized steel from 26 gage to 16 gages, in a single continuous pass for all sizes and thicknesses, as required in the HVAC industry. With the present invention, there is no restriction on duct peripheral size since no dies are necessary in the formation of the oval shaped or the round duct. The result is a straight duct with a constant cross section flow area from an inlet to an outlet without any radial peripheral or so-called transverse joint.

During fabrication of the oval shaped duct, sealing beads are also formed at one end of the flat sheet in the single continuous pass to form the duct so that a zero-leakage installation can be accomplished. This will be done through procedure known by the trademarks "Cold-Weld" applied both in the shop and in the field for permanent joint cementing of all longitudinal and transversal joints and the "Perma-Seal" procedure applied both at the shop and in the field for permanent Sealing of the permanently cemented Joint. This sealing may be achieved using adhesive products such as Henkel and Loctite.

To form the oval-shaped ducts two driving rolls (called Pinch Rolls) pull the flat or bead reinforced sheet of metal through the Machine or Apparatus while the bending roll or rolls are moved into different positions to form the curved sections of the oval shaped duct. A sensor is used to detect how far the sheet metal has moved through the rolls so that the two flat sides and the two curved sides of the oval shaped duct are formed with enough precision and accuracy so that adjacent sections of ducts can be assembled together, cemented and sealed without any leakage of air. The sensors also ensure that the metal sheet is properly aligned so their ends may be properly joined when the rolling process is finished. A first section of the first flat side of the duct is formed first, and then the first curved section is formed, followed by the second flat side, then the second curved section, and finally the second section of the first flat side, formed by moving the bending roll into or out of position for the curved section or for the flat section. After the second curved section is formed, the two will be welded, or otherwise joined and sealed together with the flat sections to form an enclosed oval shaped duct. An adhesive dispenser may be included as part of the system in order to provide the sealing material. The oval shaped duct is thus formed in a continuous operation, including the longitudinal joint that is secured during the fabrication process, resulting in a complete duct manufactured by one machine.

Steel, as well as most other materials are said to have "memory" signifying that upon forcing them to deform and releasing the force or forces that caused the deformation they will "spring-back" to eliminate the deformation caused by the application of a force on the material. This tendency to regain its original form upon the release or elimination of the force that caused the deformation of the material has to be measured and given its due consideration when forming parts, specifically upon bending them on machines called "Brakes" in the trade.

Duct fabrication does not fall within the precision or high-precision category used in many industries, such as computer parts. Air leakage has been given very little attention in the HVAC industry. The regulatory agencies ASHRAE (American Society for Heating, Refrigeration and Air Conditioning), and SMACNA (Sheet Metal and air Conditioning Contractors' National Association) have taken care of this bothersome matter by establishing arbitrary permissible air-leakage factors for ducts expressed in CFM (cubic feet per minute) per 100 Square Feet of duct surface installed in a project. Conditioned air for HVAC is somehow considered redundant or unimportant and is the only one type of fluid that is allowed in basically every industry where a newly built or construction unit can be delivered to its owner by a contractor with an uncorrected leak for any of the fluids moved within the construction site.

Now, with the advent of the new round and oval-shaped duct systems proposed with the present invention it will be possible to eliminate this undesirable condition, as the duct is sealed during its manufacture. This results in a duct that does not suffer the effects of deformation and spring-back.

A computer numerical control machine is used to control the bending roll or rolls and move to the positions required for each different size of the round or oval sections during the rolling operation. The CNC also controls the movement of the driving rolls. This movement may be manually controlled using the CNC or it can be programmed to start and stop at specific times or when a specific part of the metal sheet is detected by a sensor. The CNC may also be used to control movement of an adhesive dispenser in order to join the two end of the metal sheet at the end of the bending process. A pneumatic system, or a rack and pinion system or any other adequate mechanical electrical or electronic mechanism is used to control the position of the bending roll or rolls, and of the adhesive dispenser. Sensors indicate the appropriate position of the metal sheet where it must be bent in order to achieve the desired type of duct, round or oval-shaped.

The bending rolls can be moved into and out of position to form an oval shaped duct, or it can be moved into position to form a circular or round-shaped duct. The two driving rolls and the bending roll or rolls can be equipped with male beads and female grooves to form reinforcing beads on the duct. At the end of each of the two driving rolls a crimping ring will be provided to form a crimp on one end of the duct for insertion into another duct. Two beads of sealing material (Mastech or other types may be used) are placed in the crimped section of the round or oval duct material automatically as the duct is being formed. These beads of sealing material shall be protected during transit of the ducts to the installation site and reconditioned or reapplied at the jobs and once more permanently protected against contamination. Application of the sealing material at the shop where the duct is manufactured is preferred, as it is generally a controlled environment less susceptible to contaminants that may affect the sealants effectiveness.

To form the round ducts the bending roll or rolls are moved to the position required to form the round duct for its given diameter and held in that position until the total 360° round form is completed and then sealed and ejected from the machine. During the transformation of the round duct to an oval-shaped duct (its "ovalization" process) it is necessary to reach the yield point of the steel sheet in order to attain a permanent deformation into its final oval-shaped configuration. Although it is feasible to set-up technical and laboratory procedures to measure both pressure, and stress as well as elongation and determine with excellent precision when the yield point of the steel is reached, the shop procedures used and observed during many years determine such a result with acceptable if not equal precision. A report on elongation attained in the shop when the Yield Point of any steel piece is attained may help to gather data on this factor which may vary somewhat with mill batch composition for different batches ran at the same steel mill on different occasions. Determination of such variations prior to its actual occurrence does not add any precision to the process of ovalization or its effect on the accuracy or repeatability on the exact size of different but similar-size pieces in so far as their installation procedures or ease for field installation. However, with the addition of a new guaranteed total air leakage restriction made available with the round and oval-shaped ductwork resulting from the present invention this becomes a moot point requiring no further discussion. The sealing procedure shall be equal to that for the oval ducts.

BRIEF DESCRIPTION OF THE SEVERAL VIEWS OF THE DRAWINGS PREAMBLE

DETAILED DESCRIPTION OF THE INVENTION

To provide an overall understanding of the invention, certain illustrative embodiments and examples will now be described. However, it will be understood by one of ordinary skill in the art that the same or equivalent functions and sequences may be accomplished by different embodiments that are also intended to be encompassed within the spirit and scope of the disclosure. The compositions, apparatuses, systems and/or methods described herein may be adapted and modified as is appropriate for the application being addressed and that those described herein may be employed in other suitable applications, and that such other additions and modifications will not depart from the scope hereof.

As used in the specification and claims, the singular forms "a", "an" and "the" include plural references unless the context clearly dictates otherwise. For example, the term "a transaction" may include a plurality of transaction unless the context clearly dictates otherwise. As used in the specification and claims, singular names or types referenced include variations within the family of said name unless the context clearly dictates otherwise. Certain terminology is used in the following description for convenience only and is not limiting.

The present invention is for an apparatus that can fabricate all sizes and thicknesses of round and oval ducts that may be required for any air distribution system designed for the HVAC systems within a building or other enclosures or similar applications. These are machines that will automatically fabricate a complete set of round ducts and a complete set of oval shaped HVAC ducts in one continuous process and on one machine for a minimal cost, with reinforced flat material, and with a crimped end and two sealing beads placed on the crimped end all in one pass through the machine.

Figure 10:
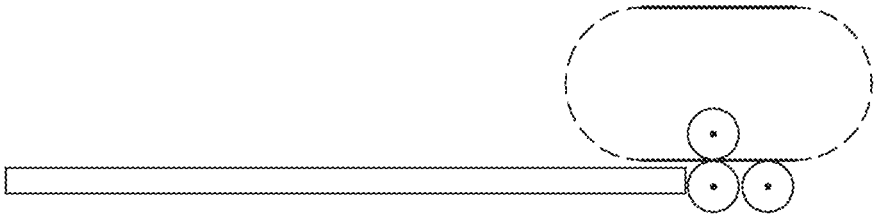
FIG. 10 shows a cross section side view of an oval-shaped duct formed by the apparatus and process of the present invention.

An oval shaped duct has two straight sides with two sides that are rounded that form a racetrack shaped duct automatically like that shown in FIG. 10. The apparatus and process of forming an oval shaped duct, as well as a round duct must be capable of forming each duct with a high precision so that sections of ducts can be assembled to form a continuous duct line or assembly with no leakage of air. The apparatus and process of forming the oval shaped duct of the present invention can take a flat sheet or a bead-reinforced sheet of metal and form the two straight sides and the two rounded sides in one continuous operation using two rolls that advance the sheet metal through and a third roller in the 3 roll machine that bends the rounded semi-circular ends. The round ducts are formed in the same machine also in one continuous operation at a much faster pace than the oval duct since the bending roll keeps the same position throughout the total bending process for these ducts. Further embodiments of the present invention comprise 4-roll and 5-roll machines that use two bending rolls instead of one bending roll.

Figure 1:
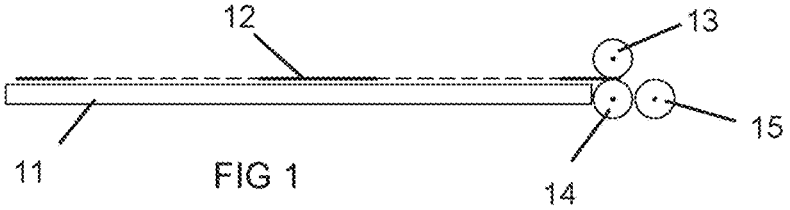
FIG. 1 shows a cross section side view of the oval-shaped duct forming apparatus of the present invention with the flat metal sheet in position to be pulled through the two drive rolls.

FIG. 1 shows the basic apparatus that will provide the oval shaped duct and includes a bed 11 on which a flat sheet of metal 12, or a bead reinforced sheet of metal of the thickness required is placed that will be formed into the oval shaped or the round duct. Two drive rolls are located on one end of the bed 11 that are connected to a motor to pull the flat or bead reinforced sheet of metal 12 through and include an upper drive roll 13 and a lower drive roll 14. Both drive rolls 13 and 14 can be adjusted to pull the various gages or thicknesses of sheet metal required in the HVAC industry for air distribution designed for buildings or other enclosures. A third roll or is an adjustable positioning bending roll 15 that will form the curved ends of the oval shaped duct or the total circular form for the round duct. For the oval ducts the bending roll is moveable in a vertical direction to one of two positions that include a non-bending position and a bending position. The bending position with be at a position to provide a specific curvature in the two rounded ends for the oval shaped duct, or for a specific curvature for the round duct. The positioning of the bending roll 15 must be accurate enough that the curved sections of the duct are reproduced for each size of the oval shaped ducts, and for the round duct formed by the apparatus, so that sections can be connected together to form a complete duct line assembly without any leakage of air. A sensor is required to determine how far the flat sheet 12 has moved through the rolls so that the bending roll 15 is moved at the proper time, ensuring that each of the flat sides are formed consistently and the curved sides are formed just as consistently for each oval shaped duct so that sections of ducts can be assembled without any leakage of air. The same requirement for consistent fabrication exists for the round ducts as for the oval ducts. The 4 and 5-roll machines use two bending rolls, synchronized, for still more accurate bends.

A sensor will be used on one of the driving rolls 13 and 14 that can determine the amount of sheet metal passed through for purposes of controlling the length of the flat sides and the start and ending of the formation of the curved sides. The sensor can detect the movement of the sheet through the rollers or the rotation of one or both rollers in order to determine the position of the sheet through the machine. Other sensors can be used to detect the length of movement of the metal sheet through the rolls in order to form the flat and curved sections with the required precision to form oval shaped ducts. Another sensor may be used to ensure the metal sheet corners are properly aligned, in order to ensure that they are properly joined. A rack and pinion mechanism or similar mechanisms may be used for this purpose.

Figure 2:
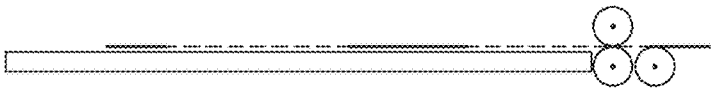
FIG. 2 shows a cross section side view of the oval-shaped duct forming apparatus of the present invention with a first flat side being formed.
Figure 3:
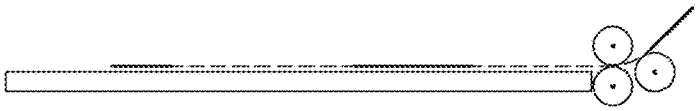
FIG. 3 shows a cross section side view of the oval-shaped duct forming apparatus of the present invention at the beginning of the first curved section of the sheet being formed.
Figure 4:
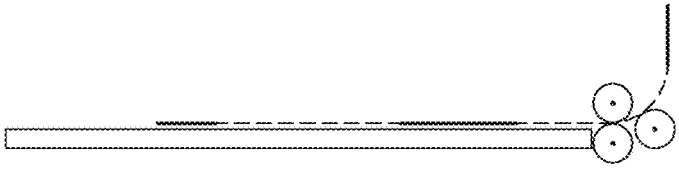
FIG. 4 shows a cross section side view of the oval-shaped duct forming apparatus of the present invention with a first half of the first curved end of the duct being formed.
Figure 5:
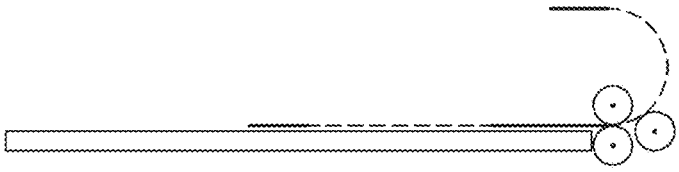
FIG. 5 shows a cross section side view of the oval-shaped duct forming apparatus of the present invention with the first curved end of the duct being formed.

FIG. 2 shows the two driving rolls 13 and 14 pulling the flat sheet through. After a specific length of the flat sheet has been pulled through, the driving rolls 13 and 14 are stopped and the bending roll 15 is moved up into place to begin forming the curvature in the duct. FIG. 3 shows the beginning of the curvature being formed. FIG. 4 shows the first half of the first curved side of the duct formed. FIG. 5 shows the first curved side of the duct totally formed.

Figure 6:
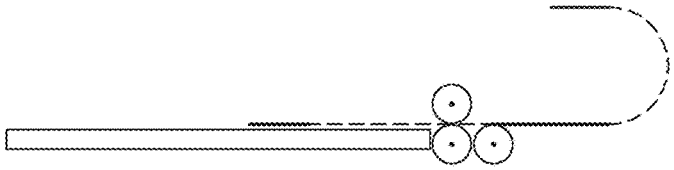
FIG. 6 shows a cross section side view of the oval-shaped duct forming apparatus of the present invention with the second flat side of the duct being formed.
Figure 7:
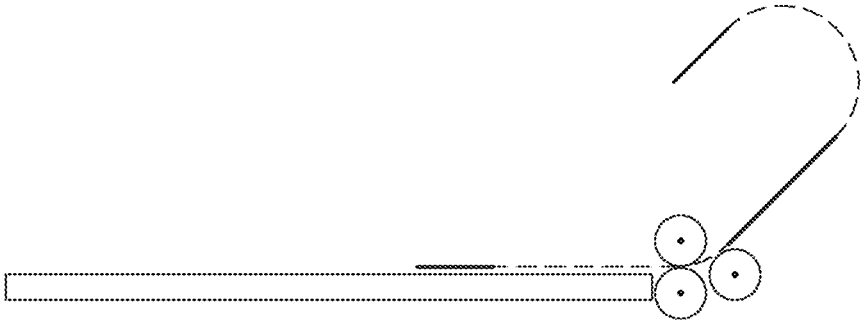
FIG. 7 shows a cross section side view of the oval-shaped duct forming apparatus of the present invention with a start of the second curved end of the duct being formed.
Figure 8:
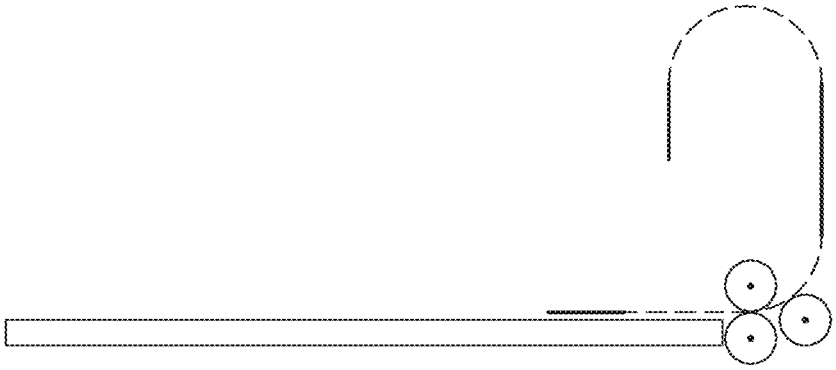
FIG. 8 shows a cross section side view of the oval-shaped duct forming apparatus of the present invention with a first half of the second curved end of the duct being formed.
Figure 9:
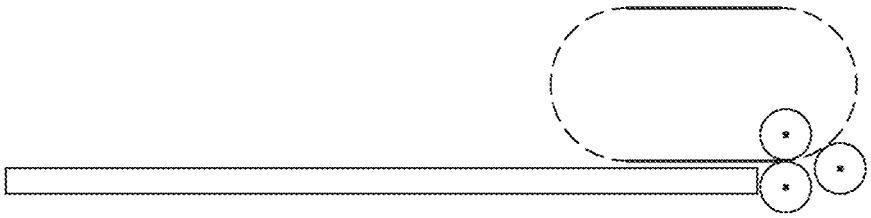
FIG. 9 shows a cross section side view of the oval-shaped duct forming apparatus of the present invention with the second curved end of the duct being formed.

After the first curved side of the duct is formed (FIG. 5), the two driving rolls 13 and 14 are stopped and the bending roll 15 is moved to the flat forming position. Then, the two driving rolls 13 and 14 pull the sheet through to form the second flat side of the duct (FIG. 6). After the first flat side of the duct is formed, the two driving rolls 13 and 14 are stopped and bending roll 15 is moved into the bending position. Then, the two driving rolls pull the sheet through to form the beginning of the second curved side of the duct as seen in FIG. 7. The two driving rolls 13 and 14 continue to pull the sheet through with the bending roll 15 in the bending position to form the first half of the second curved side of the duct (FIG. 8) and then form the second half of the second curved side of the duct (FIG. 9). At this point, the two driving rolls 13 and 14 are stopped and the bending roll 15 is moved to the non-bending position. Then, the two driving rolls 13 and 14 pull the flat side of the duct through (FIG. 10) to where the two side ends of the duct are located. At this point, an adhesive dispenser installed on the apparatus may be used to join the two side ends of the duct.

FIGS. 1-10 show the various positions of the sheet metal being formed into an oval shaped duct with two curved sides and two flat sides that are symmetric. The two driving rolls 13 and 14 pull the sheet through the apparatus and the bending roll 15 is moved into and out of the bending position to form the curved sides of the duct. Each flat side and each curved side of the duct must have lengths and curvatures formed with such precision that the shape of all ducts can be duplicated so that several of the oval shaped ducts can be joined together to form a duct line assembly for an HVAC system. The oval shaped duct in FIGS. 1-10 is formed in one continuous automatic operation. The proposed machine has the capacity required to form round and oval ducts automatically for all sizes and thicknesses required for any air distribution system in the HVAC industry since the machine is designed and built for such purpose.

Figure 11:
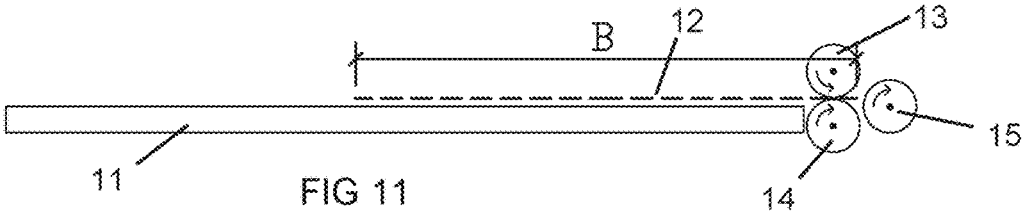
FIG. 11 shows a cross section view of a flat sheet in position to be formed into a circular shaped duct of the present invention.
Figure 12:
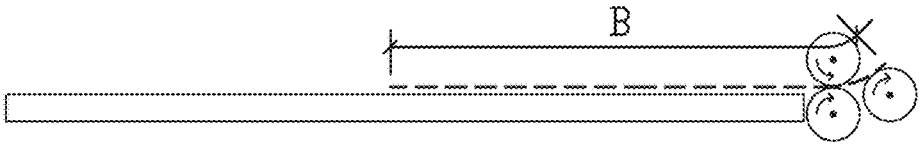
FIG. 12 shows a cross section view of the circular shaped duct beginning to be formed of the present invention.
Figure 13:
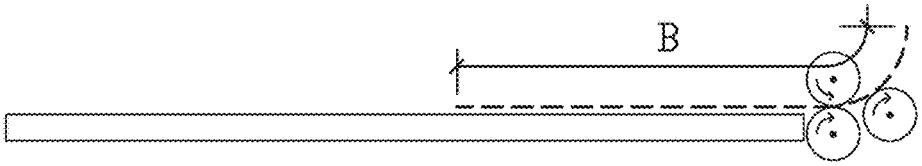
FIG. 13 shows a cross section view of the first quarter section of the circular duct being formed of the present invention.
Figure 14:
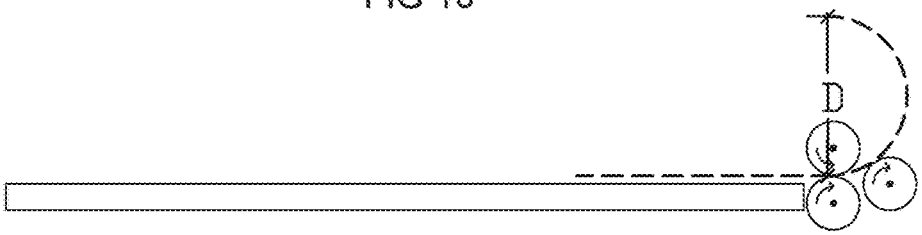
FIG. 14 shows a cross section view of the first half section of the circular duct being formed of the present invention.
Figure 15:
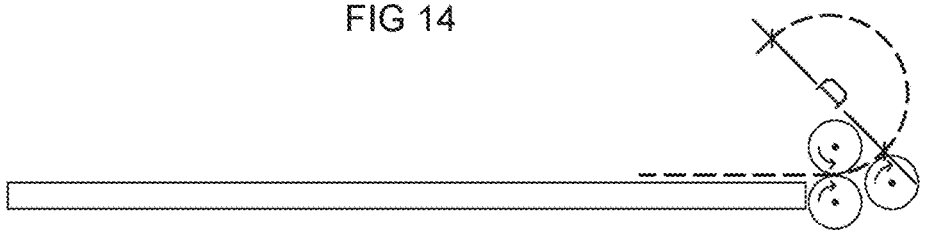
FIG. 15 shows a cross section view of the ⅝ths section of the circular duct being formed of the present invention.
Figure 16:
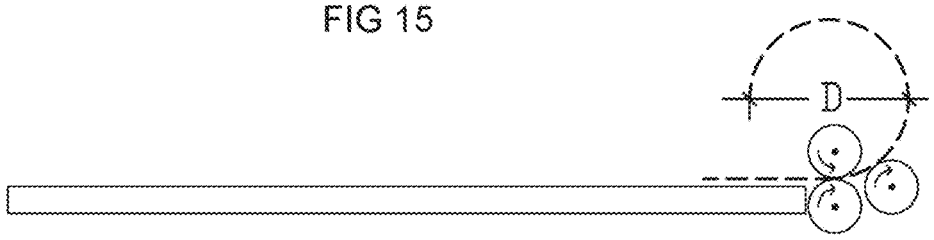
FIG. 16 shows a cross section view of the first three quarters section of the circular duct being formed of the present invention.
Figure 17:
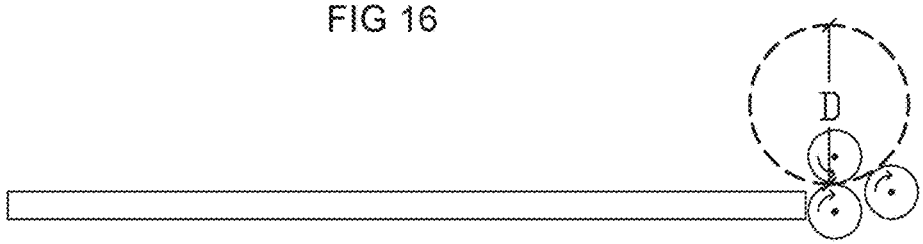
FIG. 17 shows a cross section view of the full circular duct formed of the present invention.
Figure 24:
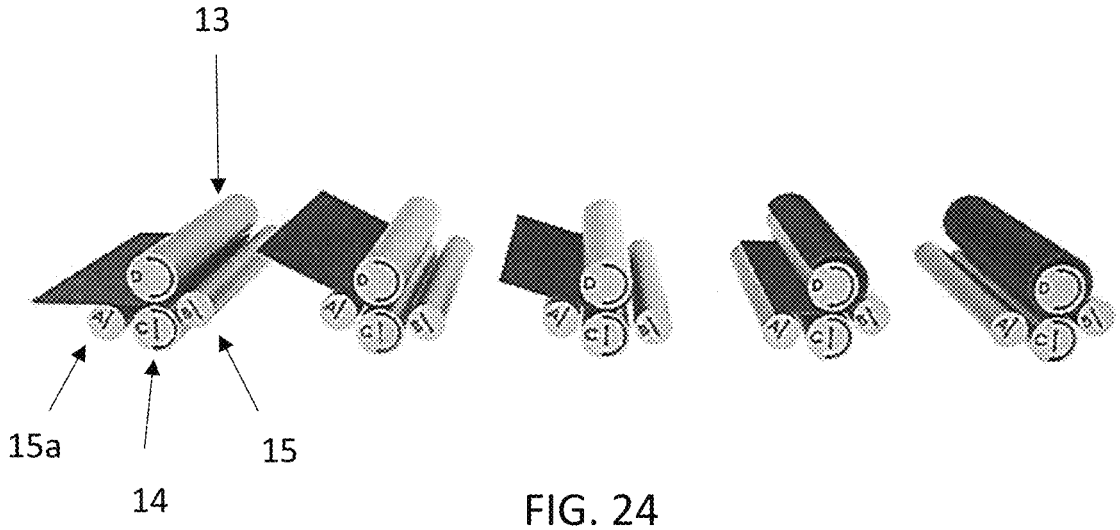
FIG. 24 shows a panoramic view of the circular and oval-shaped duct forming apparatus of the present invention with the flat metal sheet in position to be pulled through the two drive rolls and two bending rolls.

The oval shaped duct forming apparatus and process of the present invention can also form a circular shaped duct. FIGS. 11 through 17 shows the various stages of the formation of such circular shaped duct. The structure of the duct forming apparatus to form the circular shaped duct is the same as that in the oval shaped duct forming apparatus, except that the bending roller stays in the bending position the entire time without stopping the driving rolls. FIG. 11 shows the flat sheet metal being pulled through by the two driving rolls 13 and 14. FIG. 12 shows the bending roll 15 in the bending position with the two driving rolls 13 and 14 pulling the sheet through to start forming the circular shaped duct. FIG. 13 shows the first quarter section of the circular shaped duct formed. FIG. 14 shows the first half section of the circular shaped duct formed. FIG. 15 shows the first ⅝ths of the circular shaped duct formed. FIG. 16 shows the first ¾s of the circular shaped duct formed. FIG. 17 shows the entire circular shaped duct formed. In the circular shaped duct forming apparatus and process, the bending roll 15 is always in the bending position as the two driving rolls 13 and 14 are pulling the sheet through. As seen in FIG. 24, another embodiment of the present invention comprises a set of two bending rolls 15 and **15*a*, each one located at opposite sides of said driving rolls 13 and 14. This embodiment operates similarly to the one shown in FIGS. 1-10 and 11-17, except an additional bending roll 15*a* is located adjacent to the driving rolls 13 and 14 on the opposite side to where the first bending roll 15 is located. This additional bending roll 15*a* helps in forming the second half of the second curved side of the oval-shaped duct (FIGS. 8-9) or maintaining the circular shape of the circular duct once the first ¾s of the sheet have been formed by the apparatus (FIGS. 15-16**).

Figure 18:
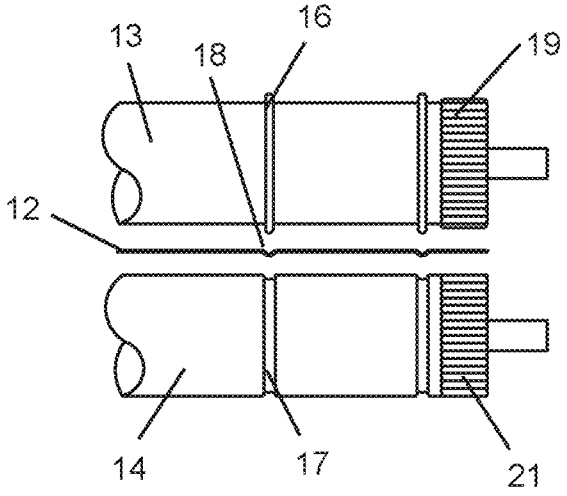
FIG. 18 shows a section of the two rolls that form beadings and a crimp end of each of the ducts formed by the rolls of the present invention.

FIG. 18 shows the two driving rolls with structure to form beads on the duct and crimps on one end of the duct. The driving roll 13 has a number of annular raised rings 16 while the driving roll 14 has an equal number of annular depressions or slots 17 opposite to the rings 16. The driving roll 13 is a male beading roller while the driving roll 14 is a female beading roller. The beading rings 16 and depressions 17 are positioned in one embodiment along the rolls every 5 1/16 inches or other adequate distance. Each set of rolls 13, 14 and 15 are at least 3 feet in length but no more than 5 feet in length in order to form a standard length duct between three to five feet. As the two driving rolls 13 and 14 pull the sheet through to form the oval or circular shaped duct, the beading rings 16 and depressions 17 will form beading 18 in the sheet that add stiffness to the sheet and therefor to the finished duct piece, so that lighter gage material can be used in accordance with SMACNA and ASHRAE requirements.

Figure 19:
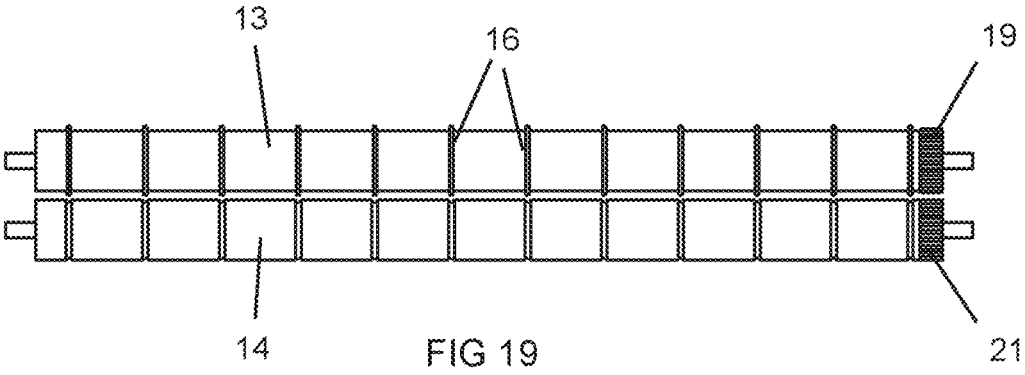
FIG. 19 shows the two rolls with the bead forming raised rings and depressed slots and the crimping beads of the present invention.

FIG. 19 also shows the two driving rolls 13 and 14 to have crimping rings 19 and 21 on one end of both rolls that together from a crimp on one end of the duct. The bending roll will also have the same female grooves as roll 14 so that the beads on the reinforced metal sheet will not be deformed while being formed into its round curvature. FIG. 19 shows two rolls 13 and 14 in the full length with the crimp rings 19 and 21 on one end.

Figure 20:
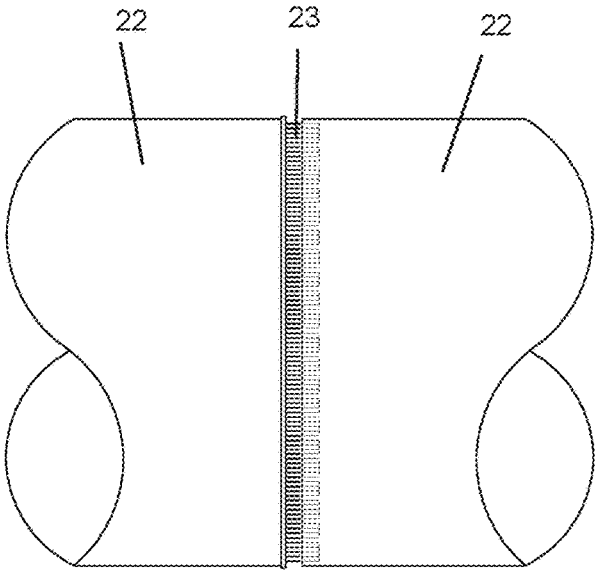
FIG. 20 shows an enlarged section of two ducts formed with a crimped end that fits within a non-crimped end of an adjacent duct of the present invention.
Figure 21:
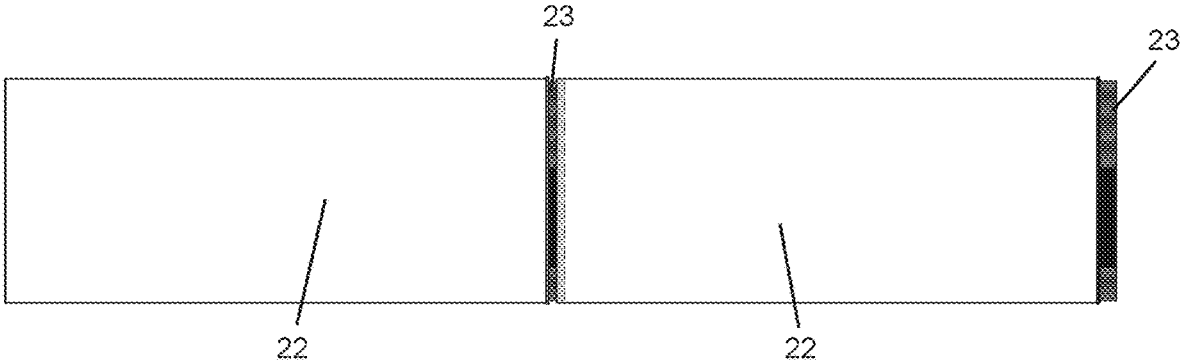
FIG. 21 shows two full ducts secured together with the crimped end inside a non-crimped end of the present invention.
Figure 22:
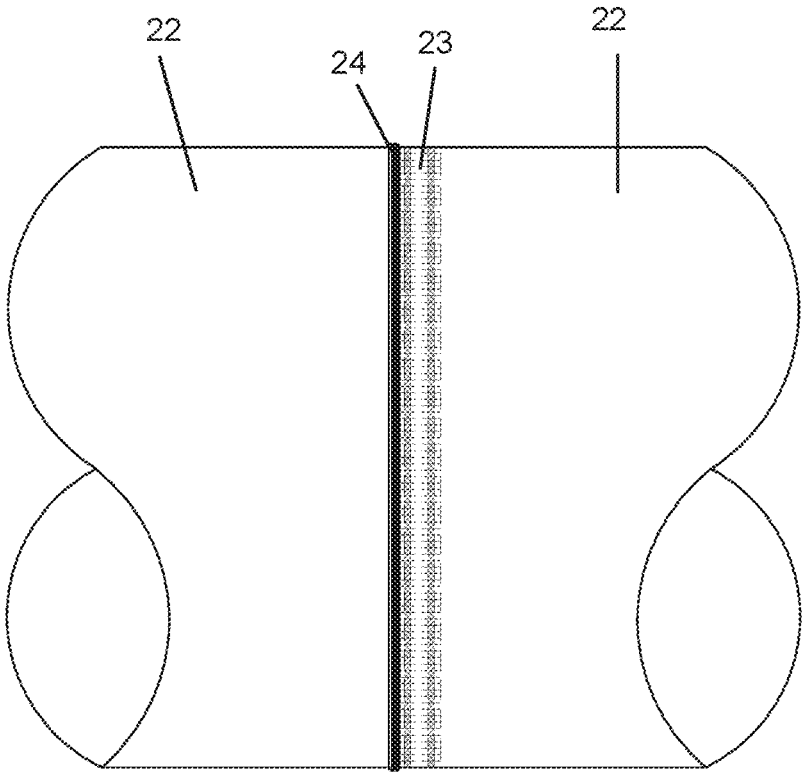
FIG. 22 shows two ducts secured together with a crimped end within a non-crimped end and a seal bead applied to one end of one of the ducts of the present invention.
Figure 23:
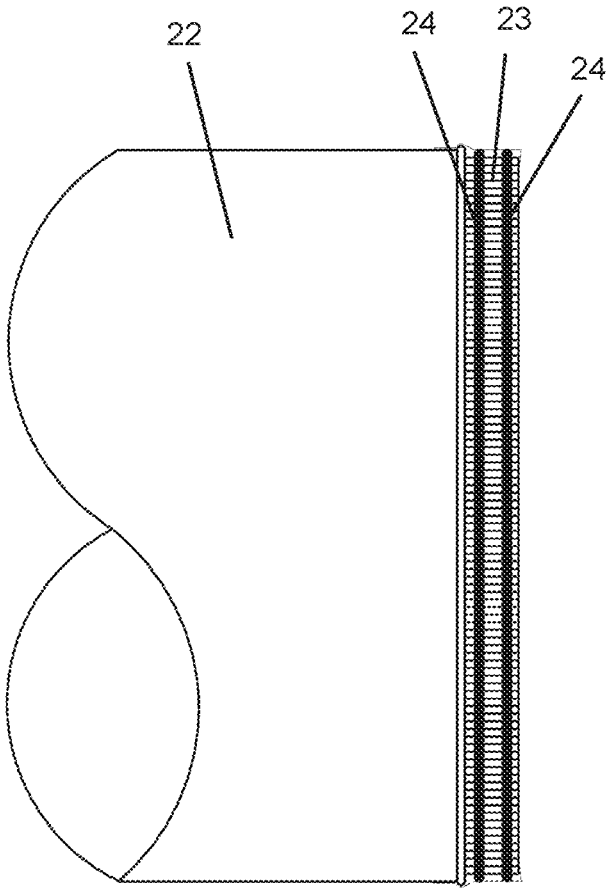
FIG. 23 shows a duct with a crimped end having two seal beads applied to the crimped end for sealing to an adjacent duct of the present invention.

The crimped end of the duct will form a smaller diameter end such that the crimped end of one duct can be inserted into another duct downstream of the former one and into its non-crimped end. FIG. 21 shows two ducts 22 secured together with one open end having the crimped form 23 that is inserted into the non-crimped end of a second duct 22. FIG. 20 shows an enlarged view of sections of two ducts 22 with the crimped end 23 inserted into the non-crimped end of the second duct 22. The beading and the crimping can be done on both the oval shaped ducts as well as on the circular shaped ducts during the single continuous pass that forms the round or oval shaped duct. A sealing bead 24 is automatically placed in two rings around the crimped end to assure proper sealing in the transverse joints between adjacent duct pieces. Installers are advised to place an additional sealing ring 24 between the crimped end and the bead next to it upon the installation of each duct piece for further assurance against air leaks in the duct line assembly. FIG. 22 shows two ends of two ducts 22 with a sealing ring 24 applied or added on the crimped end 23 of one of the ducts. FIG. 23 shows a duct in which the crimped end 23 has two sealing rings 24 applied or added to provide a greater seal than would one ring. The sealing rings may be achieved using products such as Mastech, Henkel or Loctite.

The present invention may also comprise four-rolls, with the same number of drive rolls but with two bending rolls instead of one.

Thus, the apparatus and process of forming oval shaped ducts, and round ducts of the present invention can take any gauge of flat sheet metal, or bead reinforced sheet metal that is used to form HVAC ducts, and form an oval shaped duct having two straight sides and two curved sides by advancing the flat sheet through the pinch rolls to form first a flat side, then moving the Bending Roll or Rolls to form the first curved side, then advancing the sheet metal through to form the second flat side, and then further advancing the sheet metal through to form the second curved side, and then joining the end of the first flat side together with that of the last flat side to form the oval shaped duct. By controlling the precise location of bending of the two curved sides, an oval shaped duct can be formed with high precision so that the succeeding sections can be secured together without any air leakages.

The apparatus and process of the present invention can also be used to form a circular shaped duct without modifying the structure of the oval shaped duct forming apparatus. Only the controls need to maintain the bending roll in the bending position to form the full circular shaped duct. Adding the circular shaped duct forming capability to the oval shaped duct forming apparatus and process will allow for both oval and circular shaped ducts to be formed using the same machine for all sizes and thickness of material required for air distribution systems in the HVAC Industry. Also, a crimped end can be formed during the single continuous pass duct forming process with a sealing ring applied or added to the crimped end. The benefit of an apparatus that can form both oval and circular shaped ducts for all sizes and thicknesses required in this industry is that circular shaped ducts can be formed wherever a building has enough space to fit a circular shaped duct, and the apparatus can form the oval shaped ducts where the building space is too small to fit the circular shaped duct. With the round and oval shaped duct forming apparatus of the present invention, customized shapes and sizes for ducts can be formed at the job site with a minimal cost and effort over the prior art apparatus, and also provide the ducts with zero leakage capability with the crimped ends and ring seals can be applied during the duct forming process on site as well as at the shop.

The apparatus and process of the present invention disclose that the oval shaped duct is formed with the two ends that are to be joined to form the oval shaped duct are at a middle of one of the flat sides. However, the two ends that are to be joined together can be located anywhere along the sides or the round ends of the ducts without departing from the spirit or scope of the present invention. The two ends that are to be joined can be joined within the apparatus that formed the oval shaped or circular shaped duct using an installed adhesive dispenser, or can be joined later by hand or by a second machine for a more economical machine price initially.

To form the oval shaped duct, the driving rolls are stopped at a desired position of the flat metal sheet so that the bending roll can be moved into or out of position. This stopping and starting of the two driving rolls is required to precisely form the curved sections and the flat sections with proper lengths (flat or arc lengths) so that the duct shape can be repeated and that several ducts can be assembled together with enough precision to avoid air leakage at the joints of the HVAC ducting. However, these stops are of such short a duration that the driving rolls can be almost continuously operated without stopping while the bending roll is moved into and out of the bending position. The advancement of the flat metal sheet through the three rolls can form the sides of the duct with an accuracy such that several ducts can be easily and quickly assembled to form the ducting assemblies.

The invention is not limited to the precise configuration described above. While the invention has been described as having a preferred design, it is understood that many changes, modifications, variations and other uses and applications of the subject invention will, however, become apparent to those skilled in the art without materially departing from the novel teachings and advantages of this invention after considering this specification together with the accompanying drawings. Accordingly, all such changes, modifications, variations and other uses and applications which do not depart from the spirit and scope of the invention are deemed to be covered by this invention as defined in the following claims and their legal equivalents. In the claims, means-plus-function clauses, if any, are intended to cover the structures described herein as performing the recited function and not only structural equivalents but also equivalent structures.

All of the patents, patent applications, and publications recited herein, and in the Declaration attached hereto, if any, are hereby incorporated by reference as if set forth in their entirety herein. All, or substantially all, the components disclosed in such patents may be used in the embodiments of the present invention, as well as equivalents thereof. The details in the patents, patent applications, and publications incorporated by reference herein may be considered to be incorporable at applicant's option, into the claims during prosecution as further limitations in the claims to patentable distinguish any amended claims from any applied prior art.

The invention claimed is:

1. An apparatus for forming a round or oval-shaped HVAC duct comprising:

a flat surface;

an upper driving roll and a lower driving roll located adjacent to one end of said flat surface;

a plurality of motors;

wherein said upper and lower driving rolls are operatively connected to a first motor from said plurality of motors;

at least one bending roll located adjacent to said upper and lower driving rolls;

wherein said bending roll is operatively connected to a second motor from said plurality of motors;

at least one sensor;

an adhesive dispenser operatively connected to a third motor from said plurality of motors; and a computer numerical control machine operatively connected to said plurality of motors, comprising;

a processor;

at least one memory module;

program instructions stored on said one or more memory modules for execution by said processor, the instructions comprising:

instructions to start or stop movement of said upper and lower driving rolls;

instructions to move said bending roll in a vertical manner; and instructions to move said adhesive dispenser.

2. The apparatus of claim 1, wherein said upper driving roll comprises a plurality of annular male forming beads and said lower driving roll comprises a plurality of female grooves.

3. The apparatus of claim 1, wherein an end of said upper and lower driving rolls comprises a crimped surface that forms a ring around said end of said upper and lower driving rolls.

4. The apparatus of claim 1, wherein said computer numerical control machine is manually operated.

5. The apparatus of claim 1, wherein said computer numerical control machine is programmable to be automatically operated.

6. The apparatus of claim 1, wherein said at least one sensor is an infrared sensor.

* * * * *